US010810983B2

(12) United States Patent
Ueki

(10) Patent No.: US 10,810,983 B2
(45) Date of Patent: Oct. 20, 2020

(54) ELECTRONIC ACOUSTIC APPARATUS AND METHOD FOR OPERATING THE SAME

(71) Applicant: Yamaha Corporation, Hamamatsu-shi, Shizuoka-Ken (JP)

(72) Inventor: Kazuhisa Ueki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/294,489

(22) Filed: Mar. 6, 2019

(65) Prior Publication Data

US 2019/0206377 A1 Jul. 4, 2019

Related U.S. Application Data

(63) Continuation of application No. PCT/JP2017/027919, filed on Aug. 1, 2017.

(30) Foreign Application Priority Data

Sep. 8, 2016 (JP) ..... 2016-175844

(51) Int. Cl.
*G10H 1/14* (2006.01)
*G10H 1/053* (2006.01)
(Continued)

(52) U.S. Cl.
CPC ..... *G10H 1/14* (2013.01); *G10H 1/0008* (2013.01); *G10H 1/053* (2013.01); *G10H 1/18* (2013.01);
(Continued)

(58) Field of Classification Search
CPC ..... G10H 1/14; G10H 1/0008; G10H 1/053; G10H 1/18; G10H 1/34; G10H 2210/195; G10H 2210/225; G10H 2210/265
(Continued)

(56) References Cited

U.S. PATENT DOCUMENTS 4,951,546 A * 8/1990 Takabayashi ..... G10H 3/18 84/701
5,187,630 A * 2/1993 MacKay ..... G05G 1/08 200/565
(Continued)

FOREIGN PATENT DOCUMENTS

JP 2012-185218 A 9/2012
JP 2012185218 A * 9/2012
(Continued)

OTHER PUBLICATIONS

International Search Report (PCT/ISA/210) issued in PCT Application No. PCT/JP2017/027919 dated Oct. 17, 2017 with English translation (five (5) pages).
(Continued)

*Primary Examiner* — David S Warren
*Assistant Examiner* — Christina M Schreiber
(74) *Attorney, Agent, or Firm* — Crowell & Moring LLP

(57) ABSTRACT

An electronic acoustic apparatus includes a control operator, a storage medium, and a processor. The control operator is operable by a user. The storage medium stores a program. The processor is configured to adjust a predetermined control parameter of an audio signal in response to an operation of the control operator. The processor is also configured to determine that the control operator has been operated in a particular operation style different from a normal operation style that adjusts the predetermined control parameter. In response to the operation of the control operator in the particular operation style, the processor is also configured to issue an instruction to execute a predetermined function different from an adjustment of the predetermined control parameter.

16 Claims, 3 Drawing Sheets

(51) Int. Cl.
*G10H 1/18* (2006.01)
*G10H 1/00* (2006.01)
*G10H 1/34* (2006.01)

(52) U.S. Cl.
CPC ..... *G10H 1/34* (2013.01); *G10H 2210/195* (2013.01); *G10H 2210/225* (2013.01); *G10H 2210/265* (2013.01)

(58) Field of Classification Search
USPC ..... 84/737
See application file for complete search history.

(56) References Cited

U.S. PATENT DOCUMENTS 5,290,966 A * 3/1994 Aoki ..... G06F 3/0312 84/626
5,403,970 A * 4/1995 Aoki ..... G10H 1/055 84/626
5,414,209 A * 5/1995 Morita ..... G10H 1/0066 84/615
5,627,335 A * 5/1997 Rigopulos ..... G10H 1/00 84/635
5,661,253 A * 8/1997 Aoki ..... G05G 9/047 84/658
6,011,212 A * 1/2000 Rigopulos ..... G10H 1/00 84/610
6,327,367 B1 * 12/2001 Vercoe ..... G10H 1/0091 381/61
6,376,760 B1 * 4/2002 Tozuka ..... G10H 1/18 84/610
8,609,973 B2 * 12/2013 D'Amours ..... G10H 1/0083 84/746
2007/0227335 A1 * 10/2007 Fukada ..... G10H 1/0008 84/600
2008/0163746 A1 * 7/2008 Ueki ..... G10H 1/365 84/626
2010/0018381 A1 * 1/2010 Ohshima ..... G09B 7/00 84/470 R
2010/0024628 A1 * 2/2010 Maruyama ..... G10H 1/0091 84/615
2013/0055879 A1 * 3/2013 Clark ..... G10H 1/348 84/737
2016/0063977 A1 * 3/2016 Hlatky ..... G10H 1/18 84/744
2018/0275816 A1 * 9/2018 Obata ..... G06F 3/0488
2019/0206377 A1 * 7/2019 Ueki ..... G10H 1/14

FOREIGN PATENT DOCUMENTS

JP 2012-189694 A 10/2012
JP 2012189694 A * 10/2012

OTHER PUBLICATIONS

Japanese-language Written Opinion (PCT/ISA/237) issued in PCT Application No. PCT/JP2017/027919 dated Oct. 17, 2017 (four (4) pages).
Japanese-language Office Action issued in counterpart Japanese Application No. 2016-175844 dated Sep. 3, 2019 with English translation (five (5) pages).
International Preliminary Report on Patentability (PCT/IB/373) issued in PCT Application No. PCT/JP2017/027919 dated Mar. 12, 2019, including English translation of document C2 (Japanese-language Written Opinion (PCT/ISA/237) previously filed on Mar. 6, 2019 (six pages).

* cited by examiner

ELECTRONIC ACOUSTIC APPARATUS AND METHOD FOR OPERATING THE SAME

PRIORITY

This application is based on, and claims priority to, JP PA 2016-175844 filed on 8 Sep. 2016 and International Patent Application No. PCT/JP2017/027919 filed on 1 Aug. 2017. The disclosure of the priority applications, in its entirety, including the drawings, claims, and the specification thereof, are incorporated herein by reference.

BACKGROUND

The embodiments of the present invention relate to an electronic acoustic apparatus capable of adjusting an acoustic effect parameter of an audio signal, and a method for operating such an electronic acoustic apparatus.

Electronic musical instruments have heretofore been known which are constructed to impart acoustic effects to tones. One of the known electronic musical instruments enables switching of a function to be assigned to a joystick between a performance operation function and a screen operation function in response to a user depressing a function switching switch. While the performance operation function is assigned as the function of the joystick, an acoustic effect to be imparted to a tone can be controlled. While the screen operation function is assigned as the function of the joystick, on the other hand, various screen operations can be executed on a screen displayed on a display.

With the conventional electronic musical instrument, the user can execute a desired screen operation by depressing, while the performance operation function is selected, the function switching switch so as to switch the function of the joystick from the performance operation function to the screen operation function. In such a case, however, it is necessary to stop or interrupt the performance operation, and in order to execute the performance operation again, the user has to depress the function switching switch again to switch the function of the joystick from the screen operation function to the performance operation function.

SUMMARY

In view of the foregoing prior art problems, it is one of the objects of the present invention to provide an electronic acoustic apparatus which enables function switching of a control operator to be made with a simple construction and in response to a simple operation.

In order to accomplish the aforementioned and other objects, the inventive electronic acoustic apparatus includes: a control operator operable by a user; a storage medium storing a program; and a processor configured to execute the program, the processor, when executing the program, being configured to adjust a predetermined control parameter of an audio signal in response to an operation of the control operator; determine that the control operator has been operated in (or in accordance with) a particular operation style different from a normal operation style that adjusts the predetermined control parameter; and in response to the operation of the control operator in the particular operation style, issue an instruction to execute a predetermined function different from an adjustment of the predetermined control parameter.

According to the inventive electronic acoustic apparatus, the predetermined control parameter (such as an acoustic effect parameter) for controlling the acoustic signal is adjusted in response to a user's operation of the control parameter executed in the normal operation style. Once, during such adjustment of the predetermined control parameter, the control parameter is operated in the particular operation style different from the normal operation style used for adjusting the predetermined control parameter, an instruction is issued such that the predetermined function different from the adjustment of the predetermined control parameter is executed, and thus, the predetermined function is executed in accordance with the issued instruction. In this way, the user can instruct execution of the predetermined function, different from the adjustment of the predetermined control parameter, by merely operating the same control operator in the particular operation style while adjusting the control parameter (such as an acoustic effect parameter) of the audio signal by operating the control operator. With such inventive arrangements, it is possible to eliminate a need to provide a particular or separate function switching switch and thereby achieve a simplified construction of the inventive electronic acoustic apparatus. Further, because the user can easily instruct execution of the predetermined function different from the adjustment of the predetermined control parameter by merely switching between the operation styles of the same control operator, operations to be executed by the user can be significantly simplified. In addition, the inventive arrangements allow an instruction for executing the different function to be issued easily, without substantively interrupting or stopping the adjustment of the control parameter (such as an acoustic effect parameter).

In an embodiment, the processor may be configured to detect an operating speed or acceleration of the control operator, and when the detected operating speed or acceleration is equal to or greater than a predetermined threshold value, the processor may determine that the control operator has been operated in the particular operation style. For example, when the user has moved the control operator at a speed higher than a normal speed at which the user moves the control operator for adjusting the control parameter (such as an acoustic effect parameter), the processor may determine that the control operator has been operated in the particular operation style. In this case, the user can instruct execution of the predetermined function by merely executing a quick or instantaneous, high-speed operation of the control operator during the adjustment of the control parameter (such as an acoustic effect parameter).

In an embodiment, the control operator may have a knob or a wheel operable by the user. In this case, the normal operation style may be an operation style in which the user moves the knob or wheel, for example, with a finger or a hand while contacting the knob or wheel, and the particular operation style may be an operation style in which the user quickly or instantaneously flicks the knob or wheel, for example, with a finger or a hand. In this case too, the user can instruct execution of the predetermined function by merely executing a simple and instantaneous operation of the control operator during the adjustment of the control parameter (such as an acoustic effect parameter).

In an embodiment, the predetermined function may include at least one of a display-related function and a function related to an audio-signal controlling parameter different in type from the predetermined control parameter.

In this case, the user can cause the electronic acoustic apparatus to execute at least one of the display-related function and the function related to the audio-signal controlling parameter different in type from the predetermined control parameter, while adjusting the predetermined control parameter (such as an acoustic effect parameter).

The disclosure made herein also embraces a method for operating the aforementioned inventive electronic acoustic apparatus. Also disclosed herein is a computer-readable, non-transitory storage medium storing a group of instructions executable by one or more processors for performing the aforementioned method.

BRIEF DESCRIPTION OF DRAWINGS

Certain embodiments of an inventive electronic acoustic apparatus and a method for operating the inventive electronic acoustic apparatus will hereinafter be described in detail, by way of example only, with reference to the accompanying drawings, in which.

DETAILED DESCRIPTION

(1) Construction of the Electronic Acoustic Apparatus

Figure 1:
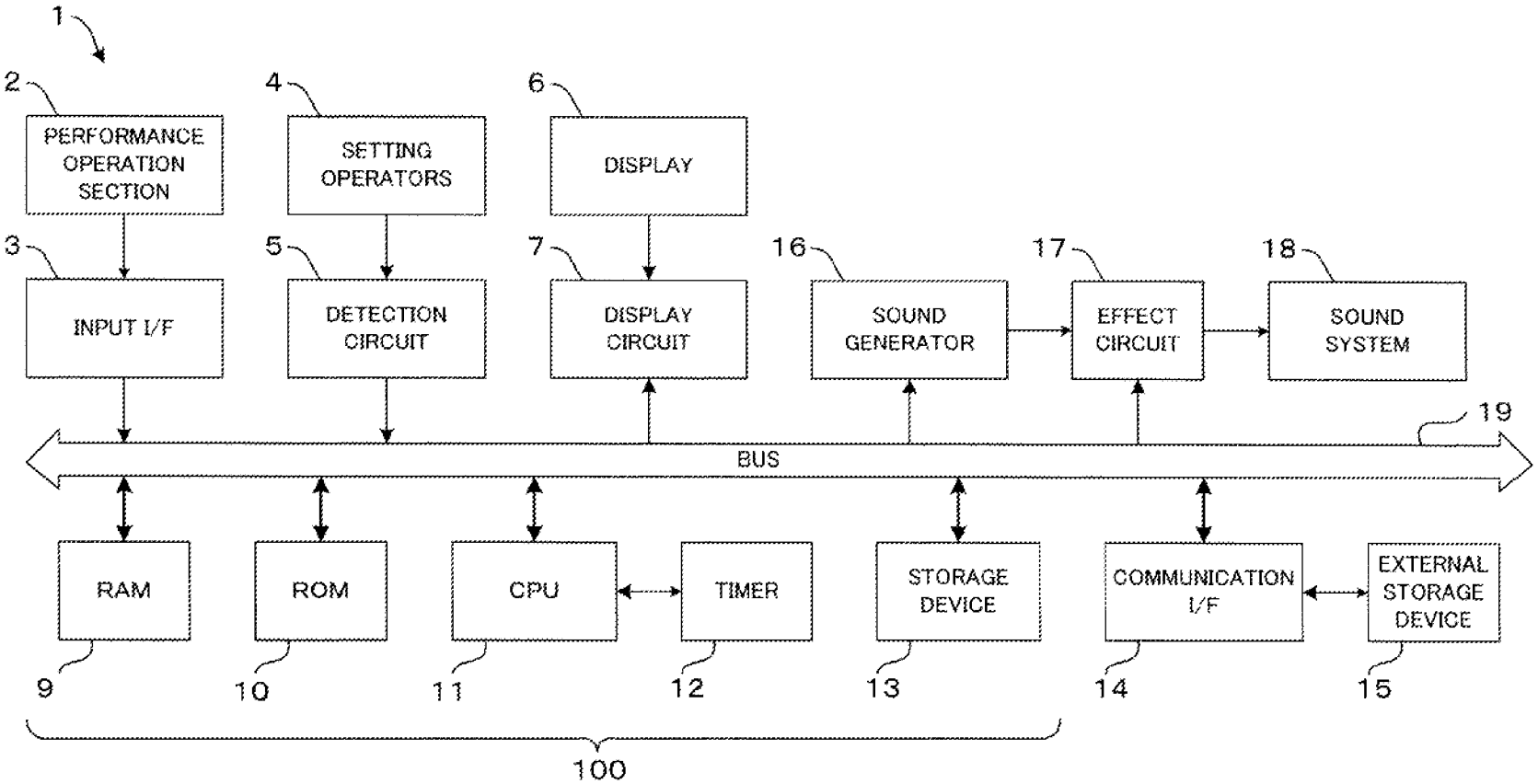
FIG. 1 is a block diagram illustrating a construction of an embodiment of an inventive electronic acoustic apparatus.

FIG. 1 is a block diagram illustrating a construction of an embodiment of the inventive electronic acoustic apparatus. The electronic acoustic apparatus illustrated in FIG. 1 is, for example, an electronic musical instrument. The electronic acoustic apparatus 1 illustrated in FIG. 1 is constructed to execute not only a function to carry out a music performance in response to performance operations executed by a user, but also other functions to do music production, such as composition and arrangement of a music piece, and editing of produced music. The electronic acoustic apparatus 1 also has functions to generate audio signals based on a manual or automatic performance and then audibly sound the audio signals.

The electronic acoustic apparatus 1 includes a performance operation section 2, an input I/F (interface) 3, a group of setting operators 4, a detection circuit 5, a display 6, and a display circuit 7. The performance operation section 2 is connected to a bus 19 via the input I/F 3, and performance data based on user's performance operations are input to the performance operation section 2. Details of the performance operation section 2 will be set forth later. The group of setting operators 4 includes an ON/OFF switch, a rotationally operable rotary encoder or a slidingly operable linear encoder, and the like, and the group of setting operators 4 is connected to the bus 19 via the detection circuit 5. These setting operators 4 are used for sound volume adjustment, turning on and off of a power source, setting, selection, adjustment, etc. of various parameters and/or functions, and the like.

The display 6 is connected to the bus 19 via the display circuit 7. On the display 6 are displayed a name of a music piece, names and values of various control parameters (including acoustic effect parameters), a musical score, and various other information. The display 6 may be in the form of a touch-panel display. In this case, the user can execute various operations by operating the display 6.

The electronic acoustic apparatus 1 further includes a RAM (Random Access Memory) 9, a ROM (Read-Only Memory) 10, a CPU (Central Processing Unit) 11, a timer 12, and a storage device 13. The RAM 9, ROM 10, CPU 11, and storage device 13 are connected to the bus 19, and the timer 12 is connected to the CPU 11. External equipment, such as an external storage device 15, may be connected to the bus 19 via a communication IF 14. The RAM 9, ROM 10, CPU 11, and timer 12 together constitute a computer, and the CPU 11 is a processor that performs various processing in the computer.

The RAM 9, which is for example in the form of a volatile memory, is used as a working area of the CPU 11, but also temporarily stores various data. The ROM 10, which is for example in the form of a non-volatile memory, stores computer programs, such as a system program and a function switching program according to an implementation of the present invention. As will be detailed later, the CPU 11 performs function switching processing according to an implementation of the present invention by executing, on the RAM 9, the function switching program stored in the ROM. The timer 12 gives time information, such as a current time, to the CPU 11.

The storage device 13 includes one or more of various storage media, such as a hard disk, an optical disk, a magnetic disk, and a memory card. One or a plurality of music piece data sets are stored in the storage device 13, and each of the music piece data sets is composed of audio signals (audio data) representative of a music piece. Here, the audio signal is composed of a plurality of sampling values obtained by sampling a waveform signal, representative of sound variation, with a predetermined sampling period. Music piece data may be created on the basis of performance data input via the performance operation section 2 and stored into the storage device 13. The above-mentioned function switching program may be stored in the storage device 13.

Similarly to the aforementioned storage device 13, the external storage device 15 includes one or more of various storage media, such as a hard disk, an optical disk, a magnetic disk, and a memory card. Various data, such as music piece data, or the function switching program may be stored in the external storage device 15.

The function switching program according to the implementation of the present invention may be supplied in a form stored in a computer-readable, non-transitory recording or storage medium and then installed into the ROM 10 or the storage device 13. Further, in a case where the communication I/F 14 is connected to a communication network, the function switching program delivered from a server connected to the communication network may be installed into the ROM 10 or the storage device 13.

The electronic acoustic apparatus 1 further includes a sound generator 16, an effect circuit 17, and a sound system 18. The sound generator 16 and the effect circuit 17 are connected to the bus 19, and the sound system 18 is connected to the effect circuit 17. The sound generator 16 generates an audio signal (in other words, a tone or sound signal) on the basis of performance data input via the performance operation section 2, music piece data given from the storage device 13, and the like.

The effect circuit 17 includes a plurality of registers for storing various control parameters (hereinafter referred to simply as "parameters") including a plurality of acoustic effect parameters. On the basis of values of the control parameters stored in the registers, the effect circuit 17 controls an audio signal (i.e., tone or sound signal) to be generated by the sound generator 16 (such control includes impartment of an acoustic effect to the audio signal).

The sound system 16 includes a digital-to-analog (D/A) conversion circuit, an amplifier, and a speaker. The sound system 18 converts a digital audio signal (i.e., tone or sound signal), given from the sound generator 16 via the effect circuit 17, into an analog audio signal (i.e., tone or sound signal) and generates a sound based on the converted analog audio signal. In this manner, the audio signal (i.e., tone or sound signal) is audibly reproduced.

(2) Operation Panel

Figure 2:
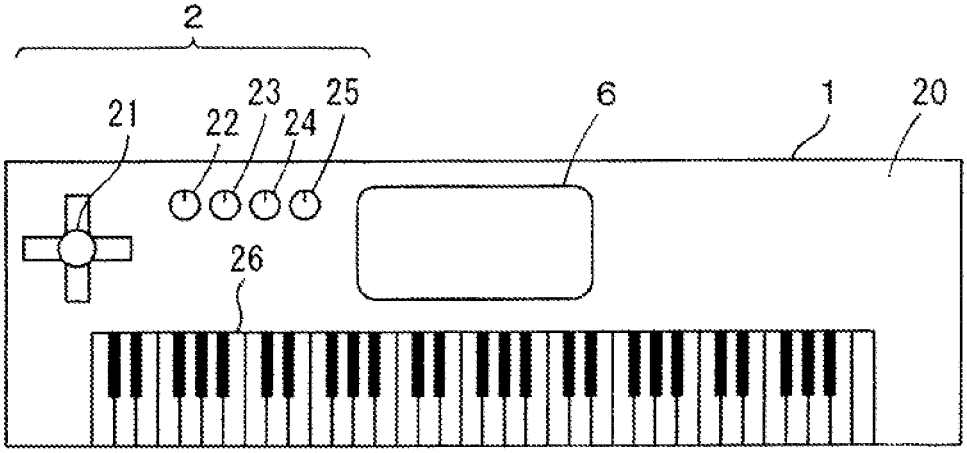
FIG. 2 is a schematic view illustrating an example of an operation panel provided in the inventive electronic acoustic apparatus of FIG. 1.

FIG. 2 is a schematic view illustrating an example of an operation panel 20 provided in the electronic acoustic apparatus 1 of FIG. 1. In FIG. 2, the performance operation section 2 and the display 6 are provided on the operation panel 20. The performance operation section 2 includes a control operator 21, various adjusting switches 22 to 25, and a keyboard 26. The control operator 21 and the adjusting switches 22 to 25 are operable to adjust values of control parameters (acoustic effect parameters). In the present embodiment, the control operator 21 is in the form of a joystick that is a type of manual operator having an operation lever operable by the user and tiltable or movable from a neutral position in each of two axis directions that are perpendicular to each other. Two types of control parameters (acoustic effect parameters) are assigned respectively to the two axis directions in which the operation lever of the control operator 21 is movable. In the present embodiment, the two types of control parameters (acoustic effect parameters) assigned respectively to the two axis directions are so-called "modulation" and "pitch bend" parameters. Other types of control parameters (acoustic effect parameters and other parameters) are assigned to the adjusting switches 22 to 25. For example, acoustic effect parameters of various types called "cut-off", "resonance", "attack", and "release" are assigned respectively to the adjusting switches 22 to 25. However, the aforementioned parameter assignment is merely illustrative, and control parameters (acoustic effect parameters) other than the aforementioned parameters may be assigned to the control parameter 21 and the adjusting switches 22 to 25. Also note that the acoustic effect parameters to be assigned are not limited to the aforementioned parameters and may be other ordinary music-controlling parameters, such as sound volume, color (timbre) numbers, and/or the like of individual performance parts of a music piece.

The control operator 21 in the form of a joystick is operable in such a manner that the user can tilt the operator 21 in a front-rear direction (Y-axis direction) and a left-right direction (X-axis direction) from the central neutral position. The control operator 21 includes an operation detector, such as a two-axis position sensor or a two-axis angle sensor, and a current operating position of the control operator 21, operated by the user, is identified by a tilted direction of the control operator 21 and an angle of the control operator 21 relative to the operation panel 20, based on results of the detection by the operation detector. The control operator 21 is constructed to have restoring force such that the operator 21 can automatically return to a state where the operator 21 is held normal to the operation panel 20 (namely, automatically return to the central neutral position). Such a neutral position is also referred to as "reference position" of the control operator 21. The user operates the control operator 21 by tilting the operator 21 in the front-rear or left-right direction against the restoring force, and once the human operator removes his or her hand from the operator 21 (i.e., releases the operator 21), the control operator 21 automatically returns to the reference position (neutral position).

Although the control operator 21 in the illustrated example is constructed in such a manner that the operation lever thereof is movable only in one of the front-rear direction (Y-axis direction) and left-right direction (X-axis direction) at a time, the inventive electronic acoustic apparatus 1 is not so limited, and the operation lever of the control operator 21 may be constructed to be movable in all directions as desired from the central neutral position. In the case where the operation lever is movable in all directions as desired from the central neutral position, respective tilt components in the two axis directions may be detected by the above-mentioned operation detector of the control operator 21. As still another example, the operation lever of the control operator 21 may be constructed in such a manner that respective tilt components in three or more directions intersecting at the neutral position, rather than only in the two perpendicular axis directions, are detected by the operation detector. In such a case, values of three or more control parameters (acoustic effect parameters) can be adjusted via the control operator 21.

In FIG. 2, as the user moves down the control operator 21 from the reference position (neutral position) toward the rear, for example, a value of the "modulation" to be imparted to an audio signal generated in the electronic acoustic apparatus 1 increases. Thus, pitch or volume of the audio signal is modulated in such a manner that vibrato or tremolo is imparted to a sound spatially generated by the sound system 18. As the user moves down the control operator 21 toward the left or right, a value of the "pitch bend" to be imparted to an audio signal generated in the electronic acoustic apparatus 1 varies.

The operation detector provided in the control operator 21, which is a conventionally known element, detects a so-called static operational state (or current operating position or angle) of the control operator 21. Generally, the user operates the control operator 21 while checking a control amount (degree of an acoustic effect) exerted on the audio signal in response to an operation of the control operator 21; thus, the control operator 21 is operated in a sustained operation style (or operation form) having a certain degree of temporal continuity or duration. Further, to maintain in a desired state the control amount (degree of an acoustic effect) to be exerted on the audio signal, the user keeps the control operator at a same operating position in a same state; thus, the control operator 21 is operated in a sustained operation style (or operation form). Typically, the operation style (operation form) used by the user in such a case includes moving a knob of the control operator 21 (i.e., the operation lever of the joystick) while keeping a same finger, hand, or other part of the body of the user in contact with the knob of the control operator 21. From the foregoing, it may be understood that when the user intends to adjust a predetermined control parameter (such as an acoustic effect parameter) of an audio signal in response to an operation of the control operator 21, the control operator 21 is operated by the user in an operation style suiting the intended adjustment of the predetermined control parameter (such as an acoustic effect parameter), such as the aforementioned sustained operation style. Such an operation style suiting adjustment of a predetermined control parameter (such as an acoustic effect parameter) of an audio signal will hereinafter be referred to as "normal operation style". The above-mentioned operation detector provided in the control operator 21 is a detector suitable for detecting an operation executed in such a "normal operation style".

By the way, if the user flicks the control operator 21 with a finger (or another part of the body), the control operator 21 moves down for a brief second and then automatically returns to the reference position (neutral position) by the restoring force. Such a flicking operation style (operation form) has almost no meaning when considered in light of the aforementioned "normal operation style". Namely, because the flicked control operator 21 quickly or instantaneously automatically returns to the reference position (neutral position) by the restoring force, there is no time for the flicking operation to be reflected in the adjustment of the control parameter (acoustic effect parameter) of the audio signal. Thus, an operation of the control operator in the flicking operation style cannot substantively perform a parameter adjusting function as performed in response to an operation of the control operator in the "normal operation style"; therefore, it has to be said that such a flicking operation style is an operation style different from the "normal operation style". Thus, in this disclosure, each operation style different from the "normal operation style", such as the one in which the user flicks the control operator 21, will hereinafter be referred to as "particular operation style different from the normal operation style" or simply as "particular operation style". As an example, the "particular operation style different from the normal operation style can be detected or determined by detecting or determining a dynamic operational state of the control operator 21. Typically, the "particular operation style" is a quick or instantaneous dynamic operation style, whereas the "normal operation style" is a continuous operation style. Further, typically, the dynamic operational state (instantaneous dynamic operation) of the control operator 21 can be detected or determined by detecting or determining an operating speed or acceleration of the control operator 21. Specific examples of such an instantaneous dynamic operation style will become apparent from behavior of the function switching section based on an operation of the control operator 21 as described below.

(3) Functional Construction of the Function Switching Section

Figure 3:
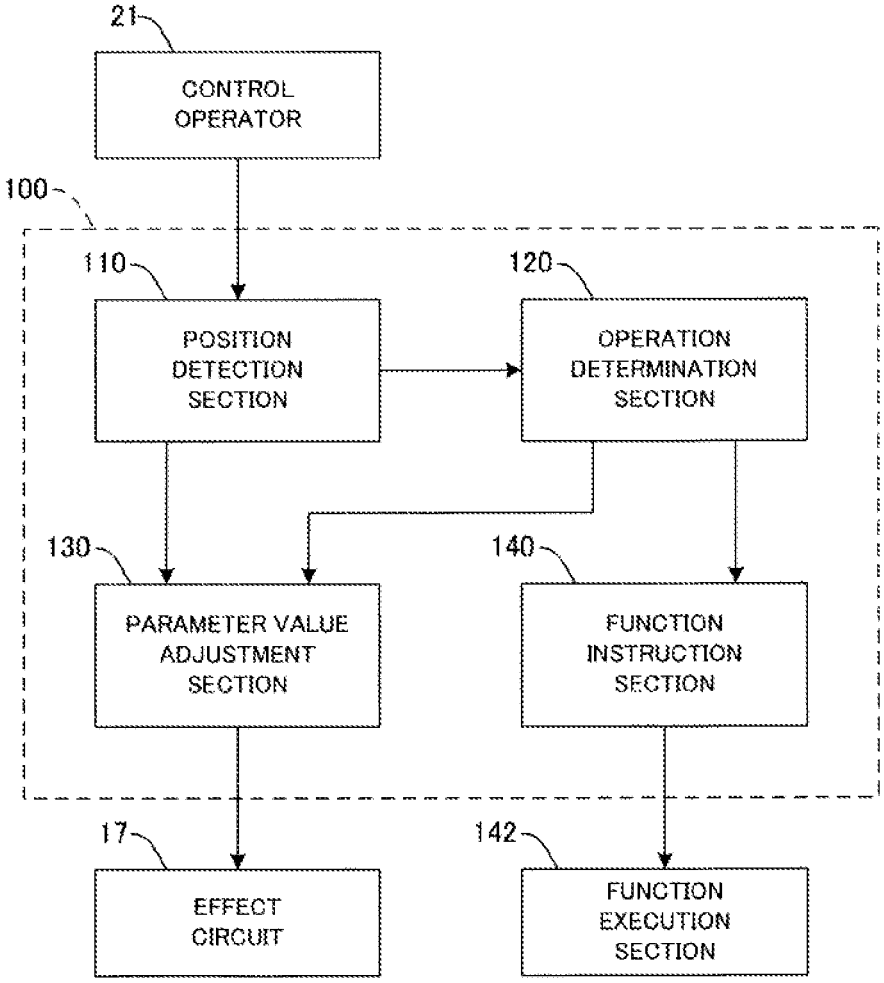
FIG. 3 is a block diagram illustrating a functional construction of a function switching section provided in the inventive electronic acoustic apparatus of FIG. 1.

FIG. 3 is a block diagram illustrating a functional construction of the function switching section. The function switching section 100 of FIG. 3 includes a position detection section 110, an operation determination section 120, a parameter value adjustment section 130, and a function instruction section 140. Functions of various portions or elements of the function switching section 100 are implemented by the CPU 11 of FIG. 1 executing the function switching program stored in the ROM 10 or the storage device 13.

The position detection section 110 detects a current operating position of the control operator 21 on the basis of output from the operator detector provided in the control operator 21 and thereby acquires operating position information of the control operator 21. On the basis of the information acquired by the position detection section 110 and variation over time of the current operating position of the control operator 21, the operation determination section 120 determines whether the executed operation of the control operator 21 is in the "particular operation style" or in the "normal operation style". The parameter value adjustment section 130 adjusts a predetermined control parameter (acoustic effect parameter) of an audio signal in response to the operation of the control operator 21. Specifically, when the control operator 21 has been operated in the "normal operation style", the parameter value adjustment section 130 adjusts the value of the predetermined control parameter on the basis of the current operating position detected by the position detection section 110. In the present embodiment, the parameter value adjustment section 130 adjusts the value of the "modulation" or "pitch bend". When it has been determined by the operation determination section 120 that the control operator 21 has been operated in the "particular operation style", the function instruction section 140 issues an instruction for executing a predetermined function. A function execution section 142 executes the predetermined function instructed by the function instruction section 140 under control of the CPU 11. In the present embodiment, the predetermined function is a display-related function. Possible examples of such a display-related function include, among others, a change of a display magnification of the screen on the display 6, a change of a type of a musical score (such as a staff notation or a piano roll) displayed on the screen, a change of language displayed on the screen, and a change of a background color of the screen. Once an instruction to the effect that a display-related function, for example, should be executed as the predetermined function is issued, a display state of the display 6 is changed promptly by the function execution section 142 (namely, through processing by the CPU 11) in accordance with the instructed function. Thus, the user can instantaneously execute a screen operation, such as a display magnification change, musical score type change, display language change, or background color change, by merely operating the control operator 21 in the "particular operation style".

For example, the user can operate the control operator 21 either in the "normal operation style" or in the "particular operation style" while a music piece is being performed by use of the keyboard 26 and/or while the music piece is being reproduced on the basis of stored music piece data. Further, the user may operate the control operator 21 in the "particular operation style" when the control operator 21 has returned to the reference position (neutral position), or may operate the control operator 21 in the "particular operation style" when the control operator 21 is at a desired position.

(4) Function Switching Processing

Figure 4:
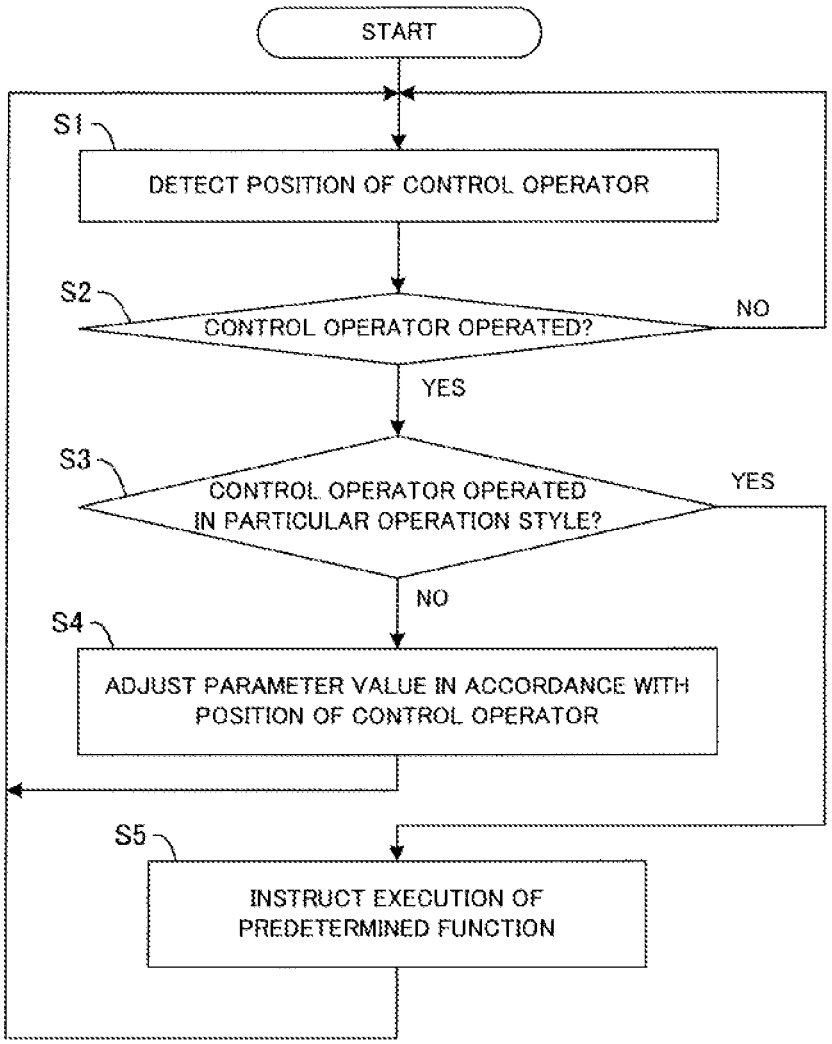
FIG. 4 is a flow chart illustrating function switching processing performed in the inventive electronic acoustic apparatus of FIG. 1.

FIG. 4 is a flow chart illustrating the function switching processing performed in the inventive electronic acoustic apparatus. The function switching processing of FIG. 4 is performed by the CPU 1 of FIG. 1 executing the function switching program stored in the ROM 10 or the storage device 13.

First, at step S1, the CPU 11 performs a function of the position detection section 110 of FIG. 3 that detects a current position of the control operator 21. Then, at step S2, the CPU 11 performs a function of the operation determination section 120 that determines, on the basis of the detected position of the control operator 21, whether or not the control operator 21 has been operated. If the control operator 21 has not been operated as determined at step S2, the processing goes back to step S1. Once the control operator 21 is operated as determined at step S2, the CPU 11 performs a function of the operation determination section 120 that determines whether or not the operation of the control operator 21 has been executed in the particular operation style. If a variation speed of the position detected by the position detection section 110 is higher than a predetermined threshold value, the operation determination section 120 determines that the control operator 21 has been operated in the particular operation style. Namely, the operation determination section 120 determines that the user has moved the control operator 21 at a speed higher than in the "normal operation style". In this way, it can be determined that the user has flicked the control operator 21 with a finger. Note that the way of determining the operation executed in the "particular operation style" is not limited to the aforementioned way; for example, the operation executed in the "particular operation style" may be determined on the basis of a speed variation pattern, acceleration, or the like of the control operator 21. Alternatively, the operation executed in the "particular operation style" may be determined on the basis of a speed variation pattern, acceleration, or the like of the control operator 21 when the control operator 21 is returned by the restoring force. Namely, because a characteristic of impact imposed on the control operator 21 in response to the flicking operation of the control operator 21, or vibration or the like of the control operator 21 caused by the flicking operation of the control operator 21 also appear as a peculiar characteristic when the control operator 21 is returned by the restoring force, such a peculiar characteristic appearing when the control operator 21 is returned by the restoring force can be determined on the basis of the speed variation pattern, acceleration, or the like of the control operator 21. Thus, as a modification, the operation determination section 120 may be configured to determine that the control operator 21 has been operated in the particular operation style, when the characteristic of impact or vibration responsive to the operation of the control operator 21 satisfies a predetermined condition. In such a case, the control operator 21 may be provided with an impact sensor or a vibration sensor.

If it has not been determined at step S3 that the operation style of the control operator 21 is the "particular operation style", this means that the operation style of the control operator 21 is the "normal operation style". In such a case, namely, if the control operator 21 has been executed in the "normal operation style", the processing goes to step S4, where the CPU 11 performs a function of the parameter value adjustment section 130 that adjusts the parameter value in accordance with the current operating position of the control operator 21. In the present embodiment, the value of the "modulation" or "pitch bend" is adjusted by the parameter value adjustment section 130. Then, the processing goes back to step S1. If it has been determined at step S3 that the operation style of the control operator 21 is the "particular operation style", on the other hand, the processing goes to step S5, where the CPU 11 performs a function of the function instruction section 140 that issues an instruction for executing a predetermined function. Then, the processing goes back to step S1. In the present embodiment, the "display-related function" as set forth above is executed in accordance with the issued instruction on the basis of another program (not shown) (namely, as a function of the function execution section 142).

(5) Advantageous Effects of the Embodiment

With the above-described embodiment of the inventive electronic acoustic apparatus 1, the user can not only adjust a value of a predetermined control parameter (such as an acoustic effect parameter) by operating the control operator 21 in the normal operation style, but also cause the electronic acoustic apparatus 1 to execute a predetermined function by operating the control operator 21 in the particular operation style. In this case, the user can adjust the parameter value and instruct execution of the predetermined function without removing his or her hand from the control operator 21. In this way, the predetermined function can be executed easily without the parameter value adjustment being substantively interrupted. As a result, a natural flow of sounds generated by the sound system 18 can be maintained, and thus, the predetermined function can be executed while the parameter value is being adjusted, with no aurally uncomfortable feeling being given to the user.

More specifically, by quickly or instantaneously flicking the control operator 21 with a finger while operating the control operator 21 to adjust the value of the "modulation" or "pitch bend", the user can cause the electronic acoustic apparatus 1 to execute the display-related function, such as a change of a display magnification of the screen on the display 6, a change of a type of musical score displayed on the screen, a change of display language on the screen, or a change of a background color on the screen. Note that it is preferable for the user to instantaneously operate the control operator 21 in the particular operation style, for example, at the end of a sound in a music piece. Thus, even when the "modulation" or "pitch bend" changes instantaneously, audience won't notice the "modulation" or "pitch bend" change.

(6) Other Embodiments (a) An operating direction in which the control operator 21 is to be operated in the "particular operation style" may be set in advance as desired. For example, it may be determined that the control operator 21 has been operated in the "particular operation style" if the operation of the control is a flicking operation, irrespective of whether the flicking is, for example, in the front-rear direction (Y-axis direction) or in the left-right direction (X-axis direction). Alternatively, it may be determined that the control operator 21 has been operated in the "particular operation style" only when the flicking operation is in the front-rear direction (Y-axis direction). As another alternative, it may be determined that the control operator 21 has been operated in the "particular operation style" only when the flicking operation is in the left-right direction (X-axis direction). As still another alternative, the flicking operation of the control operator 21 in the front-rear direction (Y-axis direction) may be determined as a first particular operation style and the flicking operation of the control operator 21 in the left-right direction (X-axis direction) may be determined as a second particular operation style in such a manner that a first type of function is assigned to the operation in the first particular operation style and a second type of function is assigned to the operation in the second particular operation style. As yet still another alternative, different functions may be assigned to a plurality of operations of the control operator 21 executed in three or more types of particular operation styles, namely, one function per particular operation style. In this way, the single control operator 21 can be used to issue instructions for executing three or more types of predetermined functions. As yet still another alternative, a plurality of types of predetermined functions may be assigned in an overlapping manner to one operation of the control operator 21 executed in a single "particular operation style". In such a case, an instruction can be issued such that the plurality of types of predetermined functions are executed simultaneously in response to the one operation of the control operator executed in the single "particular operation style".

(b) In the above-described embodiment, the reference position (neutral position) of the control operator 21 in the front-rear direction (Y-axis direction) and the reference position (neutral position) of the control operator 21 in the left-right direction (X-axis direction) are both located at the respective centers, in the front-rear direction (Y-axis direction) and left-right direction (X-axis direction), of the movable range of the control operator 21. Alternatively, however, the reference position (neutral position) of the control operator 21 in the front-rear direction (Y-axis direction) may be located at the front end or rear end of the movable range of the control operator 21, and the reference position (neutral position) of the control operator 21 in the left-right direction (X-axis direction) may be located at the left end or right end of the movable range of the control operator 21. In these cases too, the control operator 21 has restoring force to automatically return to the individual reference positions (neutral positions).

(c) The aforementioned "particular operation style" is not limited to the operation of flicking the control operator 21 with a user's finger as long as the particular operation style is an operation style different from the "normal operation style" that is used for adjusting a parameter. For example, an operation of quickly or instantaneously moving the control operator 21 at a higher speed than at the time of the parameter adjustment while holding the control operator 21 with a finger or another part of the body of the user may be determined as an operation in the "particular operation style". Alternatively, an operation of moving the control operator 21 in such a manner that a head portion of the knob of the control operator 21 makes a circle may be determined as an operation in the "particular operation style".

(d) The inventive electronic acoustic apparatus is also applicable to a music reproduction apparatus which does not have a function to enable a manual music performance as done by a musical instrument but has a function to automatically reproduce a music piece on the basis of received data, stored data, or the like. Further, the inventive electronic acoustic apparatus is also applicable to a recording/reproduction apparatus which has both a recording function and a reproduction function. In such a case, the predetermined control parameter may be a parameter for controlling a reproduction tempo. For example, arrangements may be made such that the reproduction tempo of audio signals increases or decreases relative to a recording tempo of the audio signals (at which the audio signals were recorded) in response to an operation of the control operator 21 in the front-rear direction (Y-axis direction), that reproduced sound volume (in which audio signals are reproduced) increases or decreases in response to an operation of the control operator 21 in the left-right direction (X-axis direction), and that reproduction of another audio signal is started in response to an operation of the control operator 21 in the "particular operation style". In this way, the user can switch a music piece to be reproduced to another music piece by executing a flicking operation of the control operator 21 at the end of a phrase while adjusting the reproduction tempo.

Figure 5:
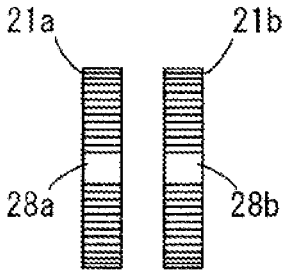
FIG. 5 is a schematic view illustrating another example of a control operator.

(e) Whereas the control operator 21 in the above-described embodiment is a joystick, the control operator 21 may a rotatable wheel. FIG. 5 is a schematic view illustrating another example of the control operator 21. In the illustrated example of FIG. 5, the operation panel 20 include two control operators 21*a* and 21*b* provided thereon in place of the control operator 21 of FIG. 2. The control operator 21*a* is a pitch bend wheel for adjusting the value of the "pitch bend", while the control operator 21*b* is a modulation wheel for adjusting the value of the "modulation". The control operators 21*a* and 21*b* are mounted to the operation panel 20 for rotation about a horizontal axis. Pressing sections 28*a* and 28*b* are provided respectively on outer peripheral surface portions of the control operators 21*a* and 21*b*.

An initial position of the control operator 21*a* is where the pressing section 28*a* is located at the center, in the front-rear direction, of the movable range of the control operator. The pitch bend value increases as the user rotates the control operator 21*a* forward (i.e., in a direction away from the user) from the reference position (neutral position), and the pitch bend value decreases as the user rotates the control operator 21*a* rearward (i.e., in a direction toward the user) from the reference position (neutral position). The control operator 21*a* has restoring force to automatically return to the reference position (neutral position). The user rotates the control operator 21*a* with a finger against the restoring force, and the control operator 21*a* automatically returns to the reference position (neutral position) once the user removes the finger from the control operator 21*a*. In the case where the control operator 21*a* is used in place of the control operator 21 of FIG. 2, an operation in which the user rotates the control operator 21*a* as if flicking the control operator 21*a* with a finger is determined as an operation in the "particular operation style". It is preferable that an operation of the control operator 21*a* in the "particular operation style" be executed instantaneously at the end of a sound in a music piece in such a manner that audience does not notice a pitch change.

An initial position of the control operator 21*b* is where the pressing section 28*b* is located at the rear end (close to the user), in the front-rear direction, of the movable range of the control operator. The modulation value increases as the user rotates the control operator 21*b* forward from the reference position. The control operator 21*b* has no restoring force and thus stops in position once the user removes a finger from the control operator 21*b*. In the case where the control operator 21*b* is used in place of the control operator 21 of FIG. 2, an operation in which the user rotates the control operator 21*b* at a higher speed than at the time of the modulation value adjustment is determined as an operation in the "particular operation style". Similarly to the aforementioned, it is preferable that an operation of the control operator 21*b* in the "particular operation style" be executed instantaneously at the end of a sound in a music piece. With the aforementioned arrangements, audience won't notice a modulation change or pitch change even when the "modulation" or "pitch bend" changes instantaneously.

(f) Whereas the predetermined function in the above-described embodiment is a display-related function, the predetermined function is not limited to a display-related function. For example, the predetermined function may be a function related to a desired control parameter (acoustic effect parameter). Examples of such a function related to a desired control parameter (acoustic effect parameter) include, among other things, a change of sound volume and a collective change of a plurality of acoustic effect parameters. In the case where the predetermined function is a change of sound volume, control can be performed such that a sound volume parameter value increases or decreases, for example, by ten each time the control operator is operated in the particular operation style. In the case where the predetermined function is a collective change of a plurality of acoustic effect parameters, control can be performed such that values of a plurality of pre-registered acoustic effect parameters are changed collectively. As another alternative, the predetermined function may be a function related to an audio signal. Examples of such a function related to an audio signal include, among other things, a change of a music piece to another one, a change of an accompaniment style to another one, and a change of a to-be-reproduced position to another position. The accompaniment style change may include an accompaniment section change. For example, reproduction of another music piece can be started by the user instantaneously operating the control operator 21 in the "particular operation style" at the end of a phrase of a currently reproduced music piece. In the case where the predetermined function is a change of a to-be-reproduced position, the to-be-reproduced position is jumped, for example, to a next rehearsal mark.

(g) Although in the above-described embodiment, the function switching section 100 of FIG. 3 is implemented by a combination of hardware, such as the CPU 11, and software, such as the function switching program, the individual elements of the function switching section 100 may be implemented by hardware, such as an electronic circuit.

One aspect of the present invention understood from the above-described embodiments is the electronic acoustic apparatus (1) which includes the control operator (21) operable by the user, the memory (10), and the processor (11), the processor (11) being configured to perform, based on a group of instructions stored in the memory (10): a task (130, S4) of adjusting a predetermined control parameter of an audio signal in response to an operation of the control operator (21); a task (120, S3) of determining that the control operator 21 has been operated in the particular operation style different from the normal operation style that is used for adjusting the predetermined control parameter; and a task (140, S5) of, in response to the operation of the control operator in the particular operation style, issuing an instruction for executing a predetermined function different from the adjustment of the predetermined control parameter.

The foregoing disclosure has been set forth merely to illustrate the embodiments of the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electronic acoustic apparatus comprising:

a control operator operable by a user;

a storage medium storing a program; and a processor configured to execute the program, the processor, when executing the program, being configured to:

determine whether the control operator has been operated in a normal operation style or a particular operation style different from the normal operation style;

when it is determined that the control operator has been operated in the normal operation style, adjust a predetermined control parameter of an audio signal in response to an operation of the control operator in the normal operation style;

when it is determined that the control operator has been operated in the particular operation style, issue an instruction to execute a predetermined function in response to an operation of the control operator in the particular operation style, the predetermined function being different from an adjustment of the predetermined control parameter; and detect an operating speed or acceleration of the control operator, wherein when the detected operating speed or acceleration is equal to or greater than a predetermined threshold value, the processor determines that the control operator has been operated in the particular operation style, but when the detected operating speed or acceleration is not equal to or greater than a predetermined threshold value, the processor determines that the control operator has been operated in the normal operation style.

2. The electronic acoustic apparatus as claimed in claim 1, wherein the processor is further configured to determine a characteristic of impact or vibration imposed on the control operator, and wherein when the determined characteristic of impact or vibration imposed on the control operator satisfies a predetermined condition, the processor is configured to determine that the control operator has been operated in the particular operation style.

3. The electronic acoustic apparatus as claimed in claim 1, wherein the control operator has a knob operable by the user, and wherein the normal operation style comprises the user moving the knob while contacting the knob, and the particular operation style comprises the user instantaneously flicking the control operator.

4. The electronic acoustic apparatus as claimed in claim 3, wherein the knob is movable in each of a plurality of directions, and the processor is configured to determine, regarding at least one of the plurality of directions, that the control operator has been operated in the particular operation style.

5. The electronic acoustic apparatus as claimed in claim 4, wherein the processor is configured to determine, regarding at least two predetermined directions of the plurality of directions, that the control operator has been operated in the particular operation style, and the processor is configured to issue the instruction to execute functions that differ from each other depending on the directions in which the control operator has been operated in the particular operation style.

6. The electronic acoustic apparatus as claimed in claim 3, wherein the control operator has a restoring force that causes the knob to automatically return to a neutral position upon the user releasing the knob.

7. The electronic acoustic apparatus as claimed in claim 6, wherein the knob is an operation lever, and the operation lever is tiltable from the neutral position in each of two axis directions that are perpendicular to each other.

8. The electronic acoustic apparatus as claimed in claim 1, wherein the control operator has a wheel operable by the user, and wherein the normal operation style comprises the user rotating the wheel while contacting the wheel, and the particular operation style comprises the user instantaneously rotating the wheel.

9. The electronic acoustic apparatus as claimed in claim 8, wherein the control operator has a restoring force that causes the wheel to automatically return to a neutral position upon ending of a user's operation of the wheel.

10. The electronic acoustic apparatus as claimed in claim 1, wherein the predetermined function includes at least one of a display-related function and a function related to an audio-signal controlling parameter different in type from the predetermined control parameter.

11. A method for operating an electronic acoustic apparatus, the electronic acoustic apparatus including a control operator operable by a user to control an audio signal, the method comprising:

determine whether the control operator has been operated in a normal operation style or a particular operation style different from the normal operation style;

when it is determined that the control operator has been operated in the normal operation style, adjust a predetermined control parameter of an audio signal in response to an operation of the control operator in the normal operation style;

when it is determined that the control operator has been operated in the particular operation style, issue an instruction to execute a predetermined function in response to an operation of the control operator in the particular operation style, the instruction causing the electronic acoustic apparatus to execute a predetermined function different from adjustment of the predetermined control parameter; and detect an operating speed or acceleration of the control operator, wherein when the detected operating speed or acceleration is equal to or greater than a predetermined threshold value, it is determined that the control operator has been operated in the particular operation style, but when the detected operating speed or acceleration is not equal to or greater than a predetermined threshold value, it is determined that the control operator has been operated in the normal operation style.

12. The method as claimed in claim 11, further comprising determining a characteristic of impact or vibration imposed on the control operator wherein wherein the determined characteristic of impact or vibration imposed on the control operator satisfies a predetermined condition, it is determined that the control operator has been operated in the particular operation style.

13. The method as claimed in claim 11, wherein the control operator has a knob operable by the user, and wherein the normal operation style comprises the user moving the knob while contacting the knob, and the particular operation style comprises the user instantaneously flicking the control operator.

14. The method as claimed in claim 13, wherein the knob is movable in each of a plurality of directions, and it is determined, regarding at least one of the plurality of directions, that the control operator has been operated in the particular operation style.

15. The method as claimed in claim 14, wherein it is determined, regarding at least two predetermined directions of the plurality of directions, that the control operator has been operated in the particular operation style, and wherein the instruction to be issued in response to the operation of the control operator is an instruction to execute functions that differ from each other depending on the directions in which the control operator has been operated in the particular operation style.

16. A computer-readable, non-transitory storage medium storing a group of instructions executable by a processor to perform a method to operate an electronic acoustic apparatus, the electronic acoustic apparatus including a control operator operable by a user to control an audio signal, when executed the group of instruction cause the processor to:

determine whether the control operator has been operated in a normal operation style or a particular operation style different from the normal operation style;

when it is determined that the control operator has been operated in the normal operation style, adjust a predetermined control parameter of the audio signal in response to an operation of the control operator in the normal operation style;

when it is determined that the control operation has been operated in the particular operation style, issue an instruction to execute a predetermined function in response to an operation of the control operator in the particular operation style, the instruction causing the electronic acoustic apparatus to execute a predetermined function different from adjustment of the predetermined control parameter, and detect an operating speed or acceleration of the control operator, wherein when the detected operating speed or acceleration is equal to or greater than a predetermined threshold value, it is determined that the control operator has been operated in the particular operation style, but when the detected operating speed or acceleration is not equal to or greater than a predetermined threshold value, it is determined that the control operator has been operated in the normal operation style.

* * * * *